United States Patent [19]

Morimoto et al.

[11] Patent Number: 4,895,274

[45] Date of Patent: Jan. 23, 1990

[54] AUGER FEEDER

[75] Inventors: Shuji Morimoto, Osaka; Hiyoshi Doi, Izumisano; Seiji Ohtani, Ibaraki, all of Japan

[73] Assignee: Takeda Chemical Industries, Ltd., Osaka, Japan

[21] Appl. No.: 204,524

[22] Filed: Jun. 9, 1988

[30] Foreign Application Priority Data

Jun. 12, 1987 [JP] Japan ..... 62-147463
Jun. 12, 1987 [JP] Japan ..... 62-147464

[51] Int. Cl.[4] ..... G01F 11/20

[52] U.S. Cl. ..... 222/63; 222/181; 222/189; 222/413

[58] Field of Search ..... 222/39, 52, 63, 181, 222/189, 236, 239, 241, 412–413, 565; 141/156, 256

[56] References Cited

U.S. PATENT DOCUMENTS

| | | | |
|---|---|---|---|
| 2,686,618 | 8/1954 | Mateer | 222/181 X |
| 3,047,034 | 7/1962 | Sassmannshausen et al. | 222/241 X |
| 3,191,642 | 6/1965 | Saito | 222/189 X |
| 3,616,968 | 11/1971 | James et al. | 222/413 X |
| 4,381,545 | 4/1983 | Biddle, III et al. | 364/479 |

FOREIGN PATENT DOCUMENTS 562724 12/1973 U.S.S.R. .

*Primary Examiner*—Michael S. Huppert
*Attorney, Agent, or Firm*—Wenderoth, Lind & Ponack

[57] ABSTRACT

An auger feeder suitable for use in subdividing and feeding of powdery particles such as precious medicines in a trace amount, because the component parts of the auger feeder can be easily disassembled for sterilization treatment before use. In addition, it can be prevented owing to the electric detection system in the auger feeder of the present invention that foreign particles resulting from the contact or the friction between the components are mixed with the powdery particles.

14 Claims, 8 Drawing Sheets

AUGER FEEDER

BACKGROUND OF THE INVENTION

The present invention generally relates to an auger feeder, wherein powder within a cylinder is metered and discharged in accordance with the rotation angle of a screw rotated within the cylinder, so that a given amount of power is discharged to fill containers.

Conventionally, in this type of auger feeder, a cylindrical metering portion is provided on the lower end portion of a funnel (so-called hopper) for holding the powder, a rotary shaft is inserted downwards from above into the funnel, and an auger screw which is loosely engaged within the cylindrical metering portion is secured to the lower end of the rotary shaft. The given amount of powder is discharged into a container through a resistor provided at the lower-end opening in accordance with the rotating angle of the screw.

The above-described auger feeder is used to supply a comparatively large capacity of granules, such as 10 grams, 100 grams and so on, to fill the containers. Generally, a rotary mechanism for an auger screw, a funnel for accommodating the weighed material such as powder or the like are secured together as one component of the filler, so that they are adapted not to be dismantled or assembled easily. Generally strict consideration is not given to preventing the mixing in of foreign matter such as dust in the operation step of discharging the weighed powder.

When powder such as medicine or the like is filled into vials or the like by the use of the above-described auger feeder, various problems are caused. Namely, an extremely strict sanitation control is required in the case of medicine or the like. Members and mechanisms, such as the auger screw, auger shaft, funnel and so on, which come into contact with the weighed material, are required to be dismantled and sterilized from time to time, so that the dismantling operation is required to be easily effected and the assembling operation is required to be easily effected after the sterilizing operation. However, in the conventional auger feeder, the auger shaft, the funnel and so on are secured as described above, so that the dismantling operation and the assembling operation are not easily effected. Also, mixtures of foreign material such as dust are required to be completely excluded from the process of filling the powder into the funnel and the process of discharging the powder into vials. Consideration is required to be given to preventing foreign material, such as dust floating in the air or falling from the portion of the machine where moving parts are frictionally engaged from being mixed with the weighed powder. In the conventional auger feeder, however, consideration is not given to such exclusion. Also, in the case of medicines such as bulk pharmaceuticals, normally powder in a small amount such as, for example, 50 mg is required to be discharged into vials or the like. But conventionally it is difficult to discharge and fill such a small amount of powder with high accuracy, because the conventional auger feeder discharges a comparatively large amount of material as described above.

In addition, in the above-described auger feeder, a resistance member such as a mesh is provided at the outlet disposed at the lower end of the metering part in order to prevent the natural falling of powdery particles to be metered. The resistance member, for example, consists of a mesh of cross knit filaments in a radial configuration. There is a limitation to these resistance members if the metering accuracy is to be improved. Let it be assumed that a predetermined amount of powdery particles to be fed is as small as 10 mg, 100 mg or the like, which is less than 1 g. When the powder particles which have adhered to the lower side of the resistance member drop all together, the amount to be fed becomes different from the predetermined amount. Further, when a powder to be fed is a very expensive medicine and the metering accuracy is required to be less than 1% so as to assure the uniformity of content, the conventional resistance members are not capable of achieving the above-described metering accuracy.

SUMMARY OF THE INVENTION

Accordingly, an object of the present invention is to provide an auger feeder in which the members which come into contact with the metered material, such as the auger screw, auger,-shaft, funnel and so on, can be easily disassembled from the container and easily reassembled therein, and which almost completely avoids entry of foreign matter such as dust during the operation thereof, which effects automatic detection to stop the operation of the auger filler in a case where foreign materials may be mixed into the metered material, i.e. where the auger screw has come into contact with the inside face of the metering portion of the container so that the sanitation may be thoroughly controlled. Furthermore, by the apparatus of the invention the powder may be discharged with high accuracy even if the amount of very small.

In accomplishing this object, according to the preferred embodiment of the present invention, there is provided an auger feeder, wherein a cylindrical metering portion is provided at the tip end portion of a funnel for accommodating powder, an auger screw is fixedly couple to the tip end of an auger shaft to rotate within the metering portion so as to cause a predetermined amount of powder to be discharged in accordance with the rotary angle of the auger screw to fill containers, characterized in that the other end of the auger shaft is detachably coupled to a rotary driving shaft provided on driving means through taper splicing, spline engagement or the like, the funnel is detachably mounted on support means so that the auger shaft which comes into contact with the powder, the auger screw, and the funnel can be freely dismantled and reassembled on the remainder of the apparatus, and in order to detect contact between the auger screw disposed in spaced relation with the inner wall of the metering portion and the metering portion, the metering portion and the auger screw are respectively made of conductive material, an electrically insulating member is provided which electrically insulates members connecting the weighing portion and the auger screw, and a power supply applies a voltage to both the conductive material parts, and an energization detecting means is provided which detects an energy flow due to contact between the auger screw and the weighing portion.

Further, in the auger feeder of the present invention, a charging hopper is provided which has a lower end extending into the funnel, and has conical side faces inclined by 60° or more with respect to the horizontal and which is curved so as to extend around the axial center of the funnel, a two-part cover closes the top opening portion of the funnel other than the charging hopper and the auger shaft, a gas feeding port for supplying gas for retaining the funnel interior under a positive pressure is provided in the cover, and a solid-gas separator which collects dust from the air within the funnel is mounted on the cover.

Furthermore, in the present invention, the auger shaft is divided into upper and lower parts which are detachably connected, and the funnel is divided into upper and lower portions detachably connected, the upper and lower funnel portions are respectively mounted in supporting means, a resisting member which prevents the natural fall of the powder when the auger is stopped is detachably mounted on the lower end opening of the weighing portion formed at the tip end of the lower funnel portion.

In addition, the auger feeder in accordance with the present invention comprises a metering cylindrical portion provided at the lower end of the funnel which holds powder, an auger screw disposed inside the cylindrical portion spaced from the inner peripheral face of the cylindrical metering portion by a predetermined amount to have a clearance in which the powder which is being metered is fed to the outlet disposed at the lower end of the cylindrical metering portion and then into a container according to the rotation of the auger screw, and a plate-shaped resistance member is mounted on the outlet at the lower end of the cylindrical metering portion and is composed of an outer peripheral frame portion, straight or curved bridges which partition the interior of the frame, and a plurality of openings surrounded by the frame portion and the bridges.

The present invention has the following advantages.

1. Because the members which come into contact with the metered material, such as the auger shaft, funnel and so on, are detachable from the remainder of the apparatus, the sterilizing operation can be easily effected.

2. Because the auger shaft is taper-spliced with a rotary driving shaft or is spline-engaged therewith, the eccentricity of the auger shaft can be controlled so that foreign matter is not produced by contact between the metering portion and the auger screw coupled to the auger shaft.

3. If the auger screw and the metering portion should contact each other, automatic detection occurs and the auger feeder can be stopped and containers with foreign matter mixed with the dispensed powder can be removed so that containers with foreign matter therein may be completely eliminated.

4. Because a large volume may be provided in the charging hopper, because the side faces have a steep slope, no bridges are formed within the charging hopper, thus requiring no vibrator.

5. As air is fed into the funnel from the gas feeding port provided in the cover of the funnel to keep the funnel interior under a positive pressure, fine dust can be prevented from being mixed into the funnel from any gap around the auger shaft, and an exhausting operation from the interior of the funnel may be effected through a dust collecting apparatus so that mixing of foreign matter with the powder in the filling step can be positively prevented.

6. The small auger feeder in which the inner diameter of the cylindrical metering portion is less than 2.15–10 mm outlet to prevent the natural falling of the powder in the cylindrical portion when the auger screw stops its rotation causes formation of bridges in the powder in the cylindrical portion but allows the powder to pass through the opening portions in the resistance member and smoothly fall when the auger screw is rotating, whereby there are no portions to which the powder adheres in piles, which eliminates erroneous metering.

BRIEF DESCRIPTION OF THE DRAWINGS

These and other objects and features of the present invention will become apparent from the following description of preferred embodiments thereof taken in conjunction with the accompanying drawings, in which.

DETAILED DESCRIPTION OF THE INVENTION

Figure 1:
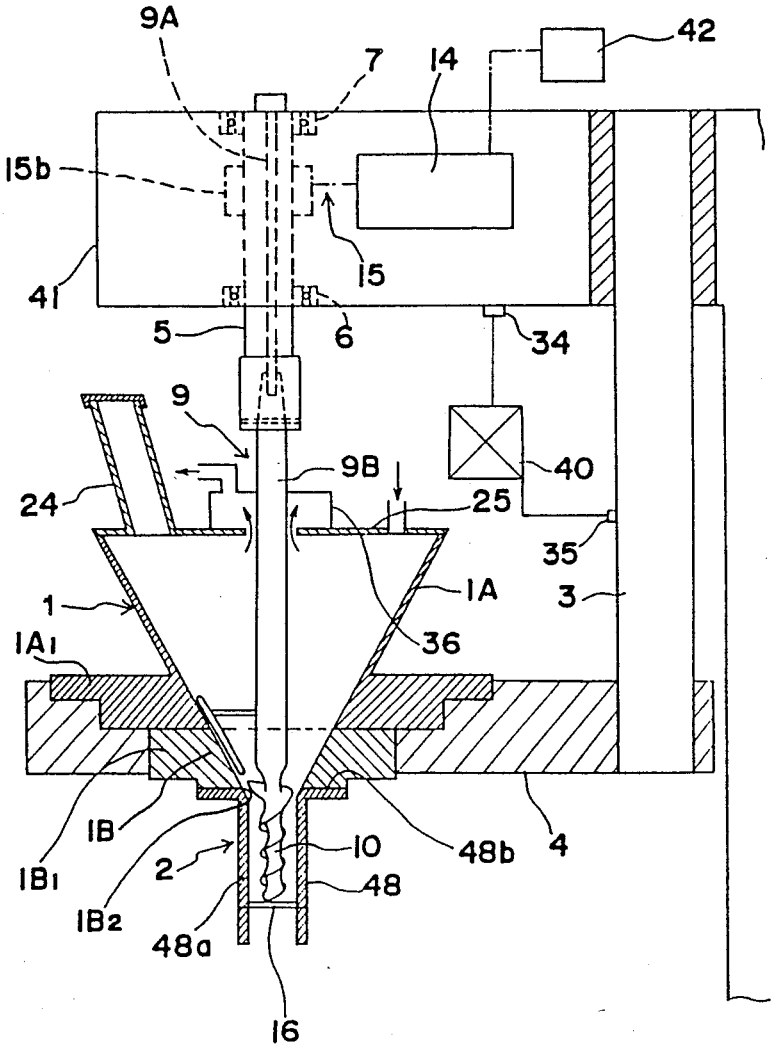
FIG. 1 is a front view, with portions in cross-section, of an auger feeder according to a first embodiment of the present invention.

Before the description of the present invention proceeds, it is to be noted that like parts are designated by like reference numerals throughout the accompanying drawings.

Referring to FIGS. 1–6 and 8, there is shown an auger feeder according to a first embodiment of the present invention. The auger feeder includes, as major members shown schematically in FIG. 1, a funnel 1, a metering cylinder 2 provided on the lower end portion of the funnel 1, a vertically extending support 3, a bracket 4 serving as a funnel supporting means extending laterally from the support 3, a rotary driving shaft 5, bearings 6 and 7 for rotatably supporting the upper and lower ends of the rotary driving shaft 5 in the frame of the apparatus, an auger shaft 9 composed of an upper shaft 9A and a lower shaft 9B, an auger screw 10 which is fixedly mounted at the lower end of the lower auger shaft 9B and is loosely engaged within the metering cylinder 2, a servo motor 14 for driving the rotary driving shaft 5, a charge hopper 24 which delivers powder to be metered and subdivided into the funnel 1, a cover 25 which closes the top opening of the funnel 1, and a contact detector 40 electrically connected between the metering cylinder 2 and the auger screw 10.

Figure 2:
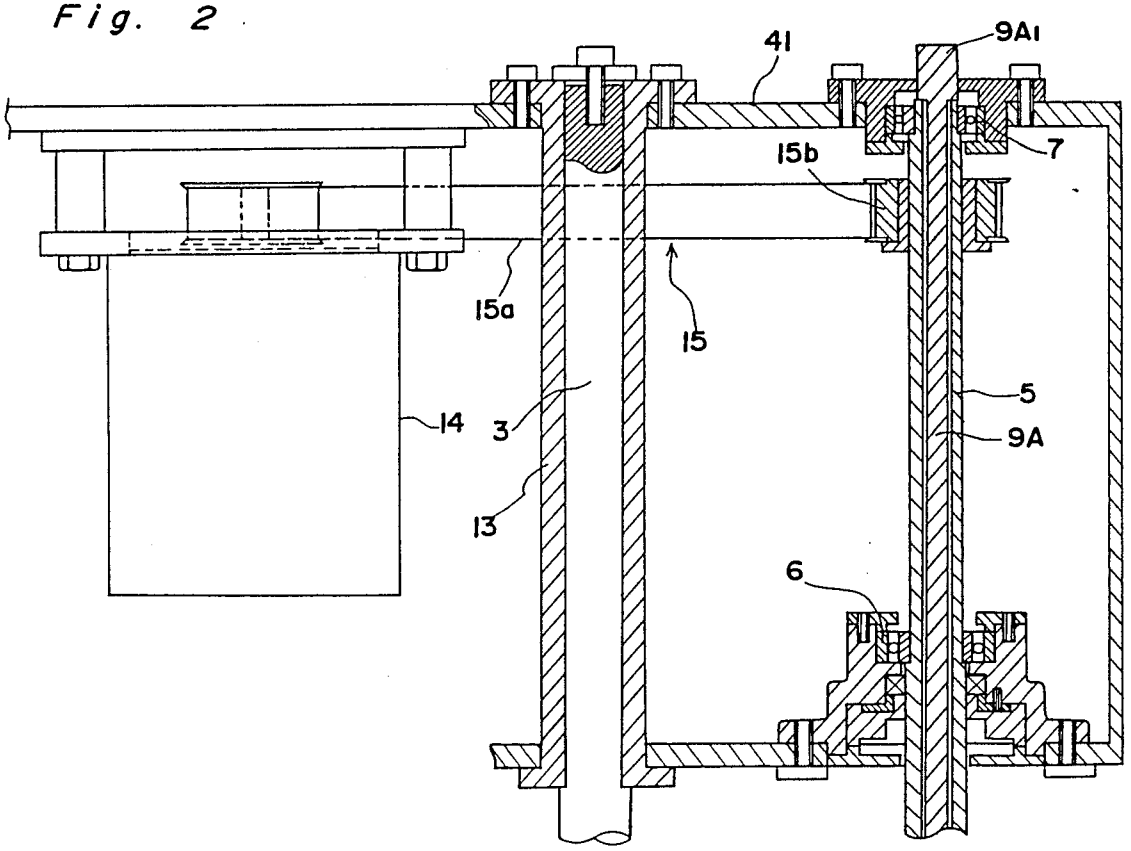
FIG. 2 is a cross-sectional view, on an enlarged scale, showing the construction of the upper part of FIG. 1.

The construction of the respective members will be described in detail in connection with FIGS. 2, 6 and 8. The servo motor 14 is provided on one side of the housing 41 accommodating the driving mechanism, while the rotary driving shaft 5 is vertically rotatably supported on the other side in bearings 6 and 7 mounted on the upper and lower frames of the housing. The driving force of the servo motor 14 is transmitted to the rotary driving shaft 5 by a pulley transmission mechanism 15 composed of a belt 15*a* and a pulley 15*b* secured to the rotary driving shaft 5. The servo motor 14 is controlled by a control unit 42 and is adapted to rotate through a given angle of rotation of the rotary driving shaft 5 and come to a stop. The rotary driving shaft 5 has a long, hollow cylindrical shape and projects downwardly from the housing 41, and the inner peripheral face of the lower end has a tapered portion 5*a* which becomes larger towards the bottom, and a pair of notches 5*b* is formed on the lower end portion.

The upper shaft 9A of auger shaft 9 is a little shorter in length than the rotary driving shaft 5, and has a mounting head or knob $9A_1$ on the top end of the upper shaft 9A supported on a support surface (unnumbered) on the upper shaft on the upper end of shaft 5, the upper shaft 9A extending into the rotary driving shaft 5 from above and being internally engaged therewith. The mounting head $9A_1$ rotates in an opening in the housing 41. A threaded portion $9A_2$ which projects into the tapered portion 5*a* of the rotary driving shaft 5 is provided on the lower portion of the upper shaft 9A. The lower shaft 9B of auger shaft 9 has an outer peripheral surface at the upper end portion thereof in the shape of tapered portion $9B_1$ which is internally engaged with the tapered portion 5*a* of the rotary driving shaft 5, and has a threaded hole $9B_2$ drilled in the top end face and a pair of pins $9B_3$ projecting laterally from the lower portion of the tapered face $9B_2$. The lower shaft 9B has the tapered portion spliced with and internally engaged with the tapered portion of the rotary driving shaft 5, the threaded hole $9B_2$ engaged with the threaded portion $9A_2$ of the upper shaft 9A, and the pair of pins $9B_3$ engaged in the notches 5*c* of the rotary driving shaft 5. Because the lower shaft 9B is fixedly coupled to the upper shaft 9A which is internally engaged with the rotary driving shaft 5, the lower shaft 9B is taper-spliced with the rotary driving shaft 5, and the auger shaft 9 may be easily dismantled and assembled, and the dismantling and assembling operation can be easily effected with respect to the rotary driving shaft 5 disposed in the housing of the driving portion. Also, because the auger shaft 9 is internally engaged in the driving shaft having a long length, eccentric rotation of the auger shaft can be eliminated.

Figure 3:
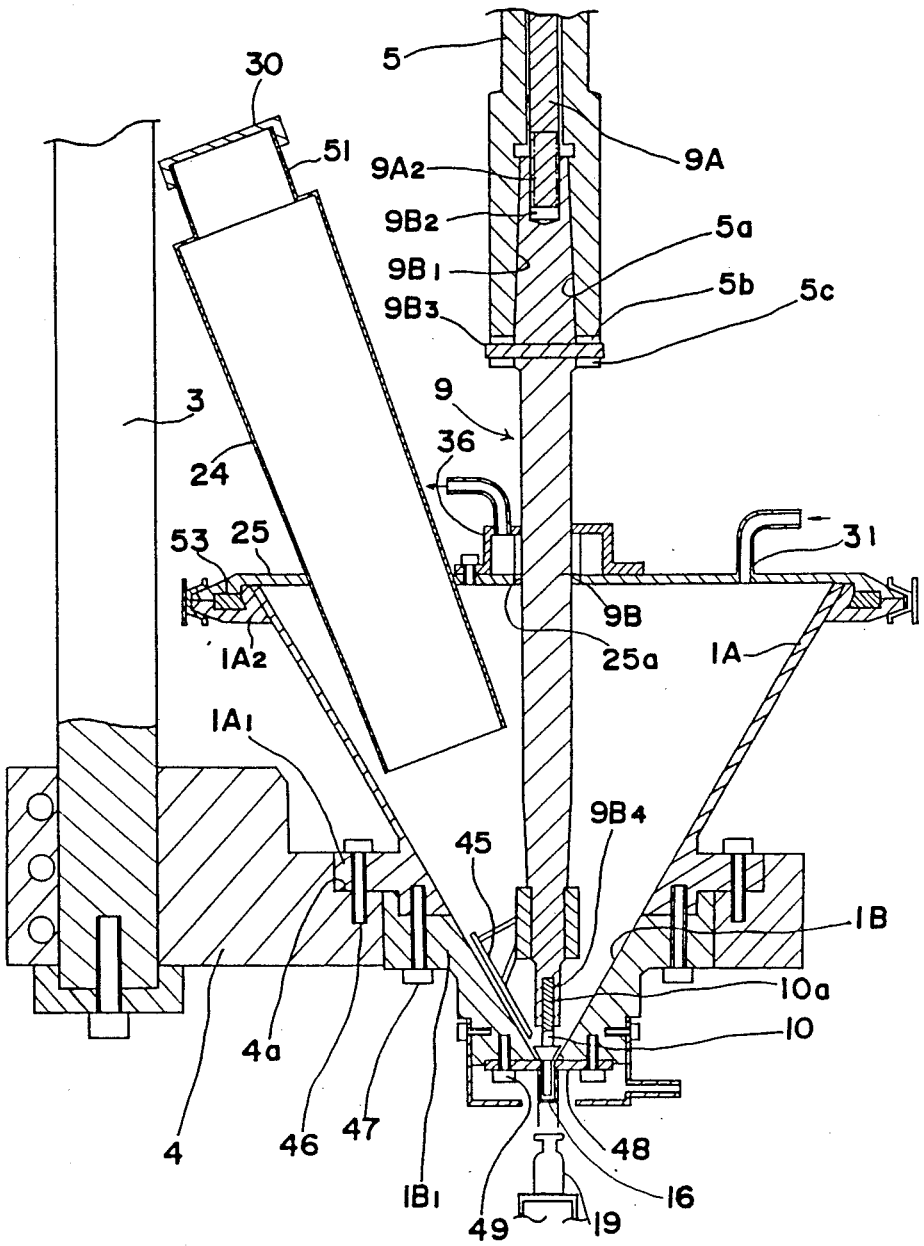
FIG. 3 is a cross-sectional view, on an enlarged scale, showing the construction of the lower part of FIG. 1.

The lower shaft 9B is inserted through the cover 25 into the axial-center portion of the funnel 1, a threaded hole $9B_4$ is drilled in the lower end portion thereof, and the upper-end threaded portion 10*a* of the auger screw 10 is threadedly engaged in the threaded hole $9B_4$. A stirring member 45 as shown in FIG. 3 for stirring the powder within the funnel 1 is mounted on the lower shaft 9B just above the auger screw 10 so as to be rotated integrally with the auger screw 10.

Figure 4:
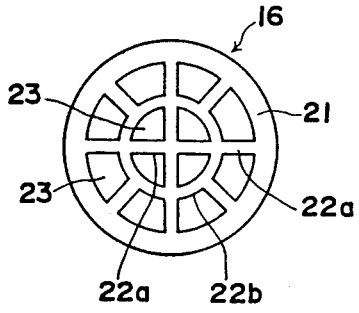
FIG. 4 is a plan view, on an enlarged scale, showing a resistance member employed in the auger feeder of FIG. 1.

The construction of the funnel 1 for accommodating the powder to be metered and subdivided is composed of two members, an upper funnel 1A and a lower funnel 1B. When the upper and lower funnels 1A and 1B coupled to each other, the inner face is connected in a conical shape. Also, the upper and lower funnels 1A and 1B are assembled in such a manner that the upper funnel 1A is detachably secured to the support bracket 4 and lower funnel 1B is detachably secured to the upper funnel 1A. To accomplish this, a stepped flange $1A_1$, which projects sideways is integrally formed on the lower end portion of the upper funnel 1A, and the bottom face of the outer stepped portion of the flange $1A_1$ is mounted on the receiving recess 4*a* formed in an aperture through the bracket 4 and is fixedly secured with bolts 46. Similarly, a stepped flange $1B_1$ projects from and is integrally formed with the lower funnel 1B, the flange $1B_1$ being engaged with the inner periphery of the aperture in the bracket 4 and the bottom of the flange $1A_1$ of upper funnel 1A, and is secured by bolts 47. Also, a screening means 48 forming the metering cylinder 2 is mounted by bolts 49 on the bottom face of the lower funnel 1B. The screening means 48 has a cylindrical skirt 48*a*, which has an inner diameter equal to the hole $1B_2$ in the bottom face axial portion of the lower funnel 1B, and a mounting flange 48*b* on the top end thereof, and a flow resistance member 16 being detachably mounted on the lower portion of the cylindrical skirt 48*a*. Because the cylindrical skirt 48*a* constitutes the metering cylinder 2, the auger screw 10 should be loosely engaged in the metering cylinder, namely, a gap of a predetermined amount is provided between the outer diameter of the auger screw and the inner peripheral face of the cylindrical skirt to avoid the internal engagement. The predetermined amount of powder which is forced down by the rotation of the auger screw 10 in accordance with the rotary angle of the auger screw 10 is filled into a bottle such as a vial 19 disposed below cylindrical skirt 48*a* through the resistance member 16. The resistance member 16 passes the powder during the rotation of the auger screw 10, but prevents the natural powder from falling during the time the rotation of the auger screw 10 is stopped. As shown in FIG. 4, the resistance member 16 is composed of an outer ring 21 having an outer periphery, a plurality of radial strips 22*a* extending inwardly from the outer ring 21, a plurality of curved strips 22*b* each extending between the radial strips and defining a plurality of opening portions 23 among the outer ring, radial strips, and curved strips.

The bottle 19 is carried to a given position by a supply conveyor (not shown) and when it is detected that the bottle has arrived at the given position, a robot places the bottle 19 in a filling holder and moves the holder to a position where the bottle has risen to a filling position.

Figure 5:
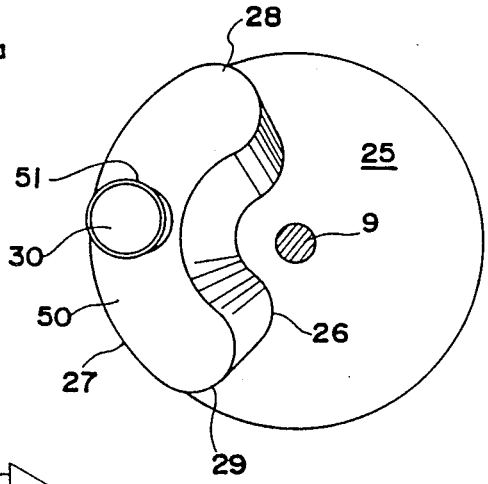
FIG. 5 is a top plan view showing a charge hopper of the auger feeder of FIG. 1.

A charge hopper 24 for feeding the powder to the funnel 1 is fixedly mounted on the cover 25 over the top opening of the funnel 1. When the cover 25 has been mounted on the funnel 1, the bottom portion of the charge hopper 24 projects into the funnel 1. As shown in FIG. 5, the upper portion of the charge hopper 24 has a side face composed of an inner conical face 26 and an outer conical face 27 concentric to the auger shaft 9, and semi-cylindrical and faces 28, 29 connecting the end of the conical faces, with the inner and outer faces being inclined by 60° or more with respect to the horizontal cover. A cylindrical supply opening 51 having a small diamater is fixedly mounted on and projects upwardly from the top 50 of the charge hopper, and a cover 30 is normally mounted over the supply opening. Because the charge hopper 24 of the above-described shape has a large cross-sectional area and is low in height, the internal volume can be made large. Because of the steep inclination of the side face, a powder bridge is not formed inside the charge hopper 24, thus requiring no vibrator to break up such a powder bridge.

The cover 25 of the funnel 1 consists of a pair of semicircular plates detachably connected to each other and surrounding the auger shaft 9, with an auger shaft engaging 25*a* being formed in the axial center of the line along which the plates are joined. The pair of plates of the cover is detachably mounted on end in a sealing engagement with the upper flange 1$A_2$ of the upper funnel 1A through an O-ring 53, and is mutually coupled by a retaining member (not shown). A gas feeding pipe 31 for feeding clean air into the funnel 1 is mounted on the cover 25, and a divided solid-gas separator 36 is mounted around the outer periphery of the auger shaft engaging 25*a* so as to surround the auger shaft 9. The air which has been fed from the gas feeding pipe 31 maintains the funnel interior under a positive pressure and is externally discharged after having a dust therein removed in solid-gas separator 36, during which time the lower portion of the funnel is blocked by the powder. The interior of the funnel 1 is retained under the positive pressure in this manner, so that fine dust is prevented from entering the interior of the funnel 1 through any gaps therein.

A contact detecting means is provided between the funnel 1 and the auger screw 10. As described above, a space is provided between the auger screw 10 and the metering cylinder 2. However, foreign matters may be mixed with the powder when they come into contact with each other. The detecting means is provided for detecting the present of foreign matter existing in the powder to enable prompt removal of the fillings.

The screening means composed of the metering cylinder 2, the funnel 1, and the support bracket 4 for supporting the funnel 1 are made of a conductive material, and a conductive current path to the support 3 is formed which extends to an electrode 35 mounted on the support 3. On the other hand, the auger screw 10, the upper and lower shafts 9A and 9B, the rotary driving shaft 5, and the support bearing 6 of the rotary driving shaft 5 are made of a conductive material to form a conductive path to an electrode 34 mounted on the housing 41. An electrically insulating material 13 is provided between the housing 41 and the support 3. The support 3 and the housing 41 are respectively connected through the electrodes 34 and 35 to a contact detector 40, the electrodes 34 and 35 are in a series circuit with a DC power supply 60 and an operation amplifier 38 with a resistor 37 is connected in parallel with the amplifier 38. The electrodes 34 and 35 are thus electrically insulated by the insulating material 13 and the gap between the auger screw 10 and cylinder 2 during the normal operation when the auger screw 10 is not in contact with the cylinder 2, and there is no potential difference between the ends of the resistor 37. When the auger screw 10 comes into contact with the metering cylinder 2, current flows between the electrodes 34 and 35 to cause the potential difference across the resistor 37. The operation amplifier 38 detects the potential difference and produces an output at terminal 38*a*. A warning means is actuated by the output signal to cause the feeder to stop.

Figure 6:
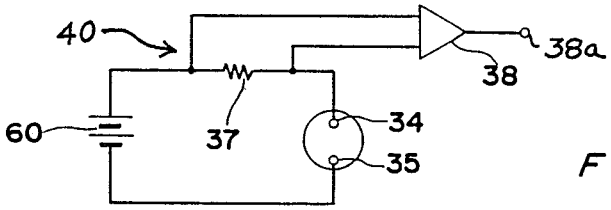
FIG. 6 is a circuit diagram of a detecting circuit employed in the auger feeder of FIG. 1.
Figure 7:
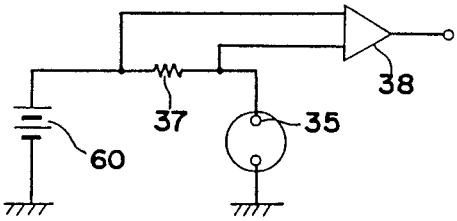
FIG. 7 is a circuit diagram of a modification of the circuit of FIG. 6.

The detecting means is not limited to the embodiment of FIG. 6. As shown in FIG. 7, the housing 41 can be grounded, and the support 3 can be connected to terminal 35 of the contact detector 40 while the other side of the contact detector 40 is connected to the ground and one terminal of the power supply 60 is grounded. The contact between the auger screw 10 and the metering cylinder 2 can be detected as described above.

With the above-described construction of the first embodiment, the dismantling operation of the members with which the powder comes into contact in order to sterilize them is effected in the following order:

1. Remove the metering cylinder 2 from the upper funnel 1A.
2. Remove the lower funnel 1B from the upper funnel 1A.
3. Remove the cover 25 from the upper funnel 1A.
4. Remove the lower auger shaft 9B from the upper auger shaft 9A.
5. Remove the upper funnel 1A from the support bracket 4.
6. Remove the upper auger shaft 9A, if necessary, from the housing 41 by releasing the engagement with the rotary driving shaft 5.

The engagement after the sterilizing operation is effected in the reverse order of the above-described order.

Figure 8:
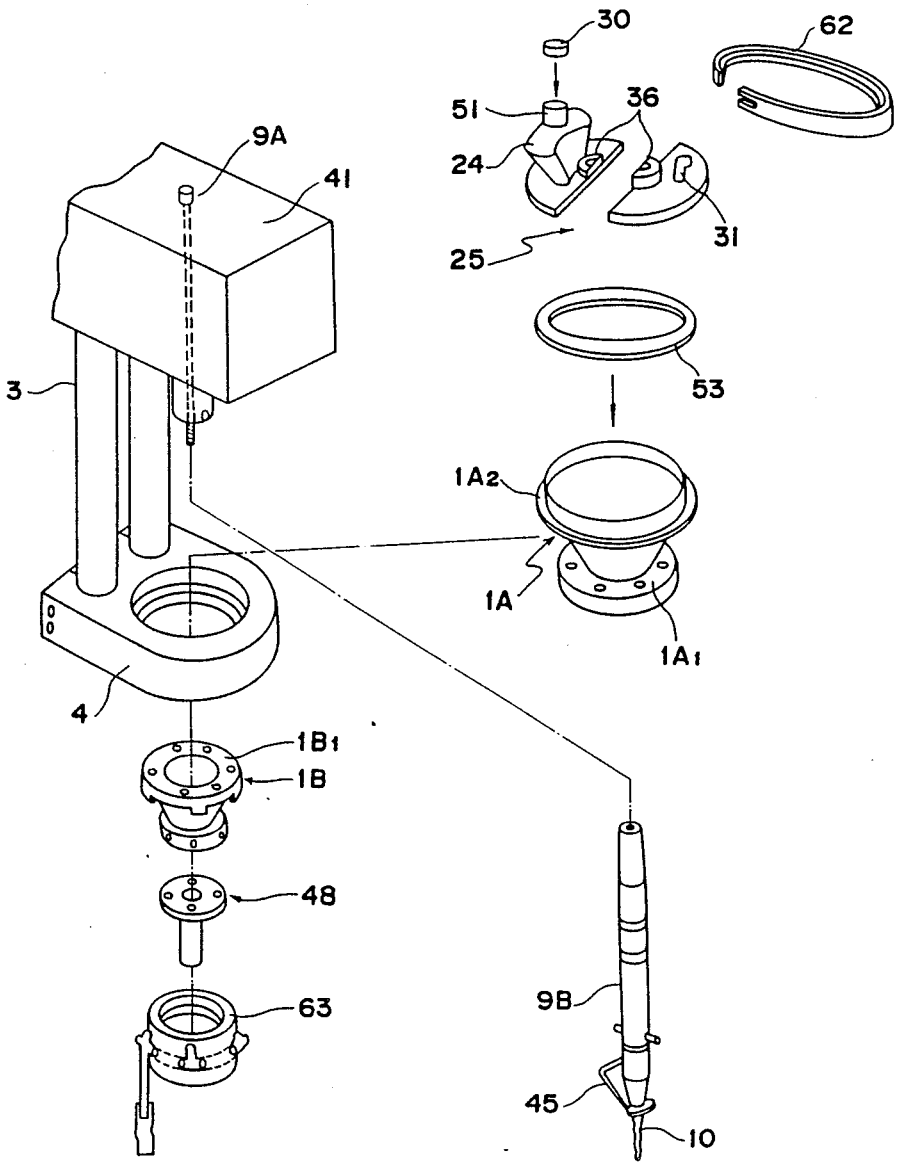
FIG. 8 is a perspective exploded view of parts of the auger feeder of FIG. 1.
Figure 9:
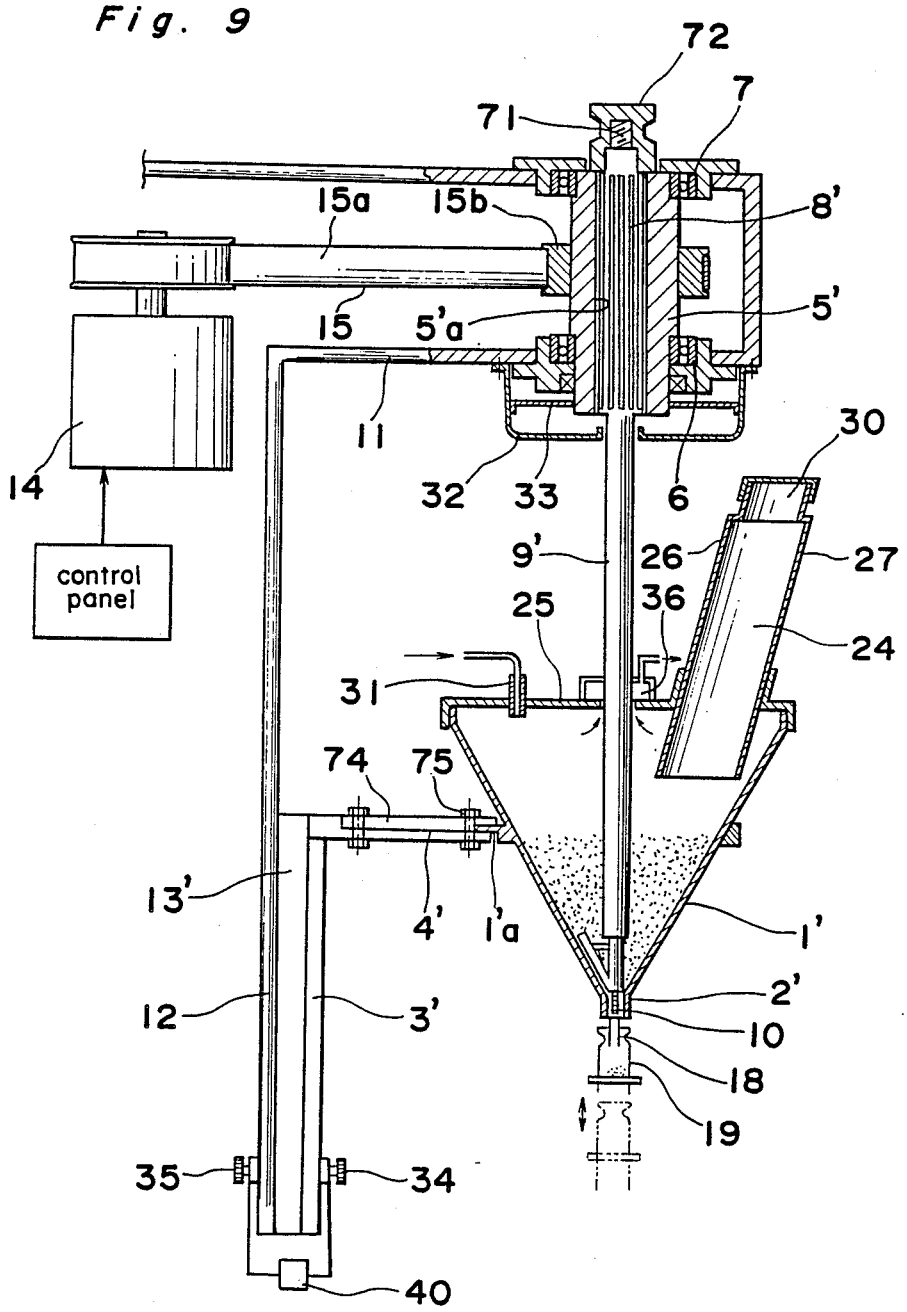
FIG. 9 is a cross-sectional view showing an auger feeder according to a second embodiment of the present invention.
Figure 10:
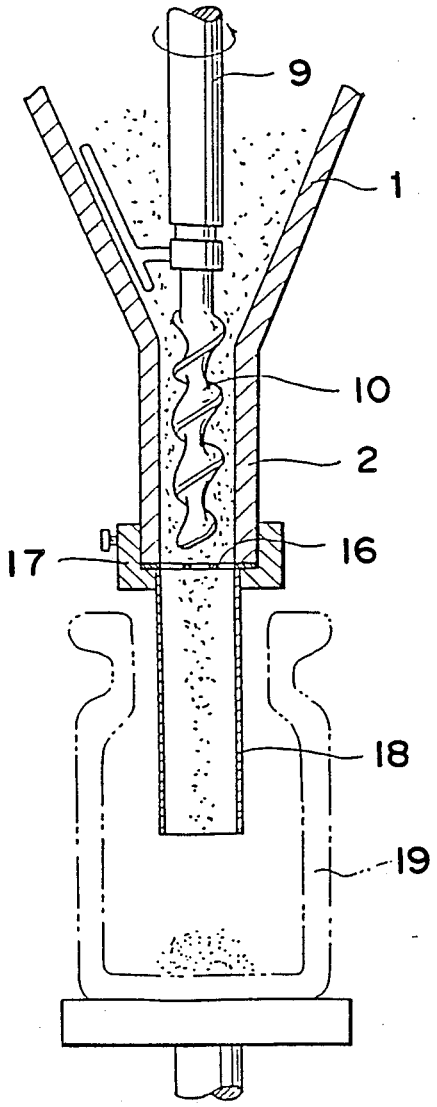
FIG. 10 is a cross-sectional view, on an enlarged scale, showing a portion of FIG. 9.

FIGS. 8 and 9 show an auger feeder in accordance with the second embodiment of the present invention. The same members as those of the first embodiment are given the same reference numerals and a description thereof is omitted.

A first difference between the second embodiment and the first embodiment is that the auger shaft 9' of the second embodiment is composed of a single member, i.e., is not divided, the upper portion, which is a root portion, of the auger shaft having an outer spline 8', with a lower portion extending from the spline 8' through the funnel 1. The outer spline 8' is engaged with an internal spline 5'*a* formed on the inner peripheral face of the rotary driving shaft 5' so that the rotating drive force can be transmitted. The axial length of the spline 8' is made to be five times or more as long as the minimum diameter of the spline portion of the auger shaft 9' to avoid eccentric rotation of the auger shaft 9' due to the spline engagement. The auger shaft 9' has a threaded portion 71 at its top end and is supported in the threaded hole 72 formed in the housing 41.

In order to prevent dust from falling onto the side of the funnel 1 from the engagement between the outer spline 8' on the auger shaft 9' and the rotary driving shaft 5, and the bearings, a semi-divided dust-proof cover 32 is mounted on the under side of a horizontal support member 11. A rotating dust-proof disc 33 is provided within the dust-proof cover 32, so that the dust falls on the outer peripheral portion of the dust-proof cover 32.

A second difference between the second and first embodiments is that the funnel 1' is an integral member, i.e. it is not divided, and a metering cylinder 2' is integrally formed on the lower end thereof. The resistance member 16 is detachably mounted on the metering cylinder 2' by a retaining member 17 engaged with the lower end face of the metering cylinder 2'. A skirt 18 for guiding the powder into a bottle 19 is provided on the retaining member 17, although the skirt 18 is not always necessary.

The second embodiment also has a somewhat different detection means. The bracket 4' and the support 3' on which the funnel 1' is supported are made of a conductive material, while the horizontal support member 11 for supporting the support bearing 6 of the rotary driving shaft 5 is coupled to a vertical base plate 12, with the base plate 12 and the base plate 3' being connected to each other through an electric insulating plate 13'. Electrodes 34 and 35 are mounted on the base plate 3 and the base plate 12 and are connected with contact detector 40.

Because the construction other than as directed above is similar to the first embodiment, and because the function is the same; a description thereof will be omitted.

In the second embodiment, the funnel 1' is removed by removing the connection with the bracket 4', and therein after the auger shaft 9' is removed from the rotary driving shaft 5'. The reassembly can be effected in the reverse order. Thus, the dismantling and reassembly operations can be very easily effected.

As is clear from the foregoing description, according to the arrangement of the present invention, the funnel, the cover and the charge hopper, the auger screw, the auger shaft and so on may be easily dismantled and reassembled, thus permitting the cleaning and sterilizing operation after dismantling. Also, because the charge hopper can be given a large volume even if the funnel is small, the number of supplying operations of the metered material can be reduced, long continuous operation can be effected while the upward facing opening of the funnel and the hopper remain closed. Furthermore, the charge hopper does not require an apparatus for preventing bridges from forming, such as vibrations or the like, thus simplifying the apparatus so that the factors for producing foreign matter are reduced and the weighing accuracy can be improved. Because the auger shaft is engaged with the rotary driving shaft over a long length, eccentric rotation of the auger shaft and the auger screw is eliminated, the contact between the auger screw and the metering cylinder can be prevented, and foreign materials can be prevented from being mixed into the dispensed material by contact among the various parts. When the auger screw comes into contact with the metering cylinder, automatic detection thereof takes place, with the various advantages that foreign matter mixed into the dispensed material can be completely removed.

Figure 11A:
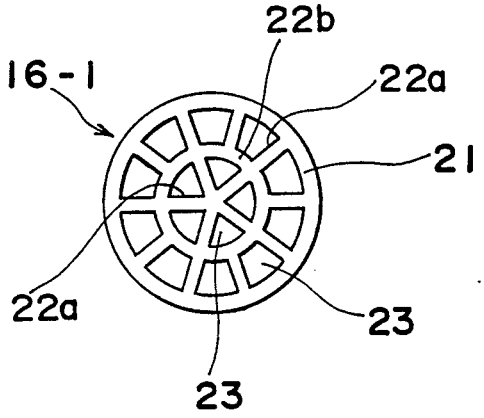
FIGS. 11(A) and (C) are views similar to FIG. 4, but showing other modifications of resistance members.
Figure 11B:
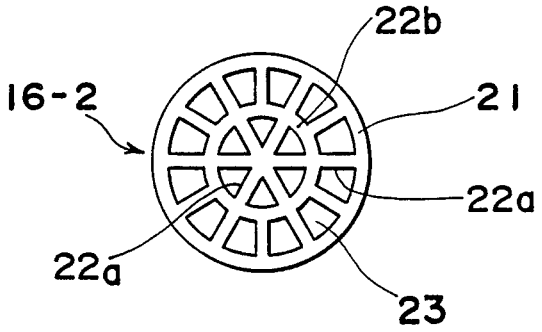
Figure 11C:
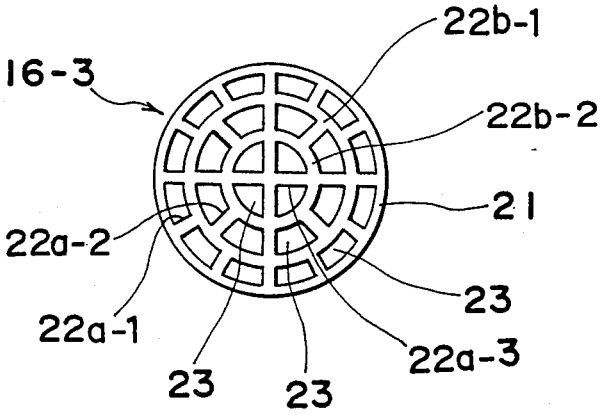

In addition, the resistance member 16 mounted on the outlet of the metering cylinder 2 as if to close the outlet has the functions of preventing the natural falling of the powder when the auger screw 10 does not rotate and causing the powder to flow down smoothly when the auger screw 10 is rotating. The resistance member 16 can be formed as shown in FIGS. 11(A)–(C) as well as shown in FIG. 4 from metallic thin plate by subjecting the plate to, for example, a laser cutting operation, a wire cutting, etching with a chemical agent, an electric discharging technique, and an ultrasonic cutting technique. These resistance members 16 all have a circular frame, i.e. an outer ring 21, and a plurality of radial strips 22*a* each extending radially from the outer ring 21 and a plurality of curved strips 22*b* each bridging the radial strips 22*a* and being concentric with the outer ring 21, the radial strips 22*a* radially partitioning the space between the outer ring 21 and the curved strips 22*b*, and the space surrounded by the curved strips 22*b* and meeting each other at the center of the outer ring to form a plurality of openings 23. Thus, a plurality of openings 23 surrounded by the outer ring 21 and the strips 22 are formed. The number of openings 23 is 12 in FIG. 4; 15 in FIG. 11(A); 18 in FIG. 11(B); and 24 in FIG. 11(C).

In FIG. 11(C), two coaxial small circular curved strips 22*b*-1 and 22*b*-2 are provided inside the outer ring 21, thus forming two concentric annular spaces. These spaces are partitioned by straight strips 22*a*-1, 22*a*-2 and 22*a*-3 which extend radially in different directions. The space surrounded by the inner circular strip 22*b*-2 is radially partitioned by straight strips 22*a*-3 in the same manner as that described above.

The dimensions and configurations of the openings of the above-described resistance member 16 are set by the following requirements.

Since the auger feeder is used to dispense a powder in amounts of 10–500 mg, the size of the particles of powder, the dimensions of the metering cylinder 2 and the auger screw 10 provided therein are set to satisfy the following requirements (a)–(c) and the dimensions of the respective portions of the resistance member 16 are set to satisfy the requirements (d)–(i).

(a) The size of the powder particles is less than 200 μm.

(b) The inner diameter of the metering cylinder 2 is in the range of 2.5–10 mm.

(c) The thread height of the auger screw 10 is in the range of 4–9.5 mm and the outside diameter is sufficiently smaller than the inner diameter of the metering cylinder 2 to leave a space of 0.2–0.8 mm.

(d) The total area of the openings 23 is more than 50% of the total area of the resistance member 16, excluding the area of the outer ring.

(e) The area of one opening 23 of the resistance member 16 is in the range of 1–5 $mm^2$.

(f) The ratio of the maximum area of the openings 23 to the minimum area thereof is less than 2.0.

(h) The corner angles of the openings 23 are more than 55°.

The corner angle referred to above is an angle formed by two sides of the opening with any rounded portion or a chambered edge between the sides disregarded or an angle formed by two tangential lines drawn from vertexes when sides are curved.

(i) The width of the strips 22 is less than 0.5 mm.

Describing specifically the resistance member 16 shown in FIG. 4, it has eight openings 23 surrounded by the outer ring 21 and the curved strips 22*b* and radially partitioned by the radial strips 22*a*, i.e. one opening 23 is surrounded by four sides consisting of one outer ring 21 and three strips 22. The resistance member 16 has four openings 23 inside the curved strip 22*a*, partitioned by the radial strips 23*b* which extend radially, i.e. they are surrounded by three sides, namely three strips 22. The areas of the openings 23 can be equalized by appropriately selecting the diameter of the circular strip 22*b*. The inner diameter of the outer ring 21 is 6 mm and the width of the strips 22 is 0.5 mm. When the areas of all of the openings 23 are equal, the longest side corresponds to the length of the inner circumferential face of the small circle and the length is 2.081 mm while the shortest side corresponds to the length of the outer circumferential face of the small circle, and the total area of the opening including the area of the respective openings of the resistance member 16 is more than 58.5% of the total area of the resistance member excluding the area of the outer ring, in addition to which the ratio of the maximum length of a line which crosses the center of gravity of an opening to the minimum length of a line which crosses it is 7A and is less than 1.83.

According to experiments conducted by mounting the resistance member 16 shown in FIG. 4 and FIGS. 11(A)–(C) on an auger feeder in which the maximum outer diameter of the auger screw 10 is 5.5 mm and the inner diameter of the metering cylinder 2 is 6 mm so as to dispense 50 mg of medicine particles by auger feed, neither a caking phenomenon was observed in the funnel nor a natural falling of the medicine particles occurred when the auger screw stopped. The metering accuracy was kept to less than ±0.5 mg (less than ±1%) by selecting a resistance member suitable for pharmaceutical powder. Also, powdery particles to be dispensed are unlikely to adhere to the resistance member of the outlet construction in accordance with the present invention, which avoids having an amount of them drop all together, unlike conventional outlet constructions in which powdery particles which have adhered to a resistance member fall all together. Thus, the metering accuracy can be improved. Accordingly, the outlet construction of the present invention has advantages that can be utilized to dispense trace amounts of powdery particles by auger feed.

Although the present invention has been fully described by way of example with reference to the accompanying drawings, it is to be noted here that various changes and modifications would be apparent to those skilled in the art. Therefore, unless such changes and modifications depart from the scope of the present invention, they should be construed as being included therein.

What is claimed is:

1. An auger feeder comprising:

a frame having a funnel support member thereon;

a funnel supported on said support member for accomodating a powder to be dispensed and having a metering cylinder at the lower end thereof;

drive means on said frame and having a rotational driving shaft;

an auger shaft having an upper and adjacent said drive means and extending through said funnel;

an easily disconnectible connecting means detachably connecting the end of said auger shaft adjacent said driving means with said rotational driving shaft of said driving means for causing said auger shaft and said rotational driving means to rotate together;

an auger screw secured to the lower end of said auger shaft and located within said metering cylinder with a space between the inner surface of said cylinder and said auger screw for causing powder accommodated within said funnel to be metered and dispensed in predetermined amounts in response to the rotation of said auger shaft through predetermined corresponding angles so as to feed powder into containers;

an easily assembled and disassembled supporting means on said funnel detachably mounting said funnel around the lower portion of said auger shaft so as to be able to easily disassemble the funnel and auger shaft from the support member of said frame;

a first conductive member on said frame and electrically connected with said metering cylinder and a second conductive member on said frame and electrically connected with said auger shaft, and an insulating means electrically insulating said conductive members from each other;

a power source for supplying electric power across said first and second conductive members; and a detecting means connected to said conductive members and said power source for detecting a variation of electric power conducted between said conductive members due to an accidental contact between said metering cylinder and said auger screw.

2. An auger feeder as claimed in claim 1 in which said connecting means comprises an exteriorly splined portion on said auger shaft and an interiorly splined portion on said rotational driving shaft.

3. An auger feeder as claimed in claim 1 in which said connecting means is a taper connection.

4. An auger feeder comprising:

a frame having a funnel support member thereon;

a funnel supported on said support member for accommodating a powder to be dispensed and having a metering cylinder at the lower end thereof;

drive means on said frame and having a rotational driving shaft;

an auger shaft having an upper end adjacent said drive means and extending through said funnel;

an easily disconnectible connecting means detachably connecting the end of said auger shaft adjacent said driving means with said rotational driving shaft of said driving means for causing said auger shaft and said rotational driving means to rotate together;

an auger screw secured to the lower end of said auger shaft and located within said metering cylinder with a space between the inner surface of said cylinder and said auger screw for causing powder accommodated within said funnel to be metered and dispensed in predetermined amount in response to the rotation of said auger shaft through predetermined corresponding angles so as to feed powder into containers;

an easily assembled and disassembled supporting means on said funnel detachably mounting said funnel around the lower portion of said auger shaft so as to be able to easily disassemble the funnel and auger shaft from the support member of said frame;

a cover for said funnel including a pair of half circular plates mounted on said funnel to cover the upper opening of the funnel and being engaged around said auger shaft, said cover having an air supply port for supplying air into said funnel for producing a positive pressure within said funnel, and an air discharge port for discharging excess air from said funnel; and a charge hopper mounted on said cover and having opposite spaced parallel lateral surfaces with a conical shaped curved around one side of the axis of said auger shaft and inclined at an angle of greater than 60 degrees to the upper surface of said cover, and having a lower opening opening into said funnel for feeding powder into said funnel.

5. An auger feeder comprising:

a frame having a funnel support member thereon;

a funnel supported on said support member for accomodating a powder to be dispensed and having a metering cylinder at the lower end thereof;

drive means on said frame and having a rotational driving shaft;

an auger shaft having an upper end adjacent said drive means and extending through said funnel;

an easily disconnectible connecting means detachably connecting the end of said auger shaft adjacent said driving means with said rotational driving shaft of said driving means for causing said auger shaft and said rotational driving means to rotate together;

said rotational driving shaft having an axial hole extending through the center thereof, a support surface on the upper end thereof and an internally tapered portion on the lower end thereof;

said auger shaft having an upper shaft with a knob at the upper end thereof and a threaded portion at the lower end, and a lower shaft having a threaded hole and an externally tapered portion at the upper end thereof, said upper shaft being in the axial hole with said knob on said support surface and the lower shaft having said threaded portion of the upper shaft engaged in said threaded hole and said internally tapered portion of said drive shaft engaged with said externally tapered portion so as to form an integral connection between the upper shaft and the lower shaft;

an auger screw secured to the lower end of said auger shaft and located within said metering cylinder with a space between the inner surface of said cylinder and said auger screw for causing powder accommodated within said funnel to be metered and dispensed in predetermined amounts in response to the rotation of said auger shaft through predetermined corresponding angles so as to feed powder into containers;

an easily assembled and disassembled supporting means on said funnel detachably mounting said funnel around the lower portion of said auger shaft so as to be able to easily disassemble the funnel and auger shaft from the support member of said frame;

a cover for said funnel including a pair of half circular plates mounted on said funnel to cover the upper opening of the funnel and being engaged around said auger shaft; and a charge hopper on said cover for feeding powder into said funnel.

6. An auger feeder as claimed in claim 5 in which said funnel includes an upper member having the upper opening therein and a lower member having said metering cylinder thereon, said upper member being detachably mounted on said funnel support member and said lower member being detachably mounted on said upper member.

7. An auger feeder as claimed in claim 5 further comprising:

a first conductive member on said frame and electrically connected with said metering cylinder and a second conductive member on said frame and electrically connected with said auger shaft, and an insulating means electrically insulating said conductive members from each other;

a power source for supplying electric power across said first and second conductive members; and a detecting means connected to said conductive members and said power source for detecting a variation of electric power conducted between said conductive members due to an accidental contact between said metering cylinder and said auger screw.

8. An auger feeder comprising:

a frame having a funnel support member thereon;

a funnel supported on said support member for accomodating a powder to be dispensed and having a metering cylinder at the lower end thereof;

drive means on said frame and having a rotational driving shaft;

an auger shaft having an upper end adjacent said drive means and extending through said funnel;

an easily disconnectible connecting means detachably connecting the end of said auger shaft adjacent said driving means with said rotational driving shaft of said driving means for causing said auger shaft and said rotational driving means to rotate together;

said rotational driving shaft having an axial hole extending through the center thereof, said hole having an interiorly splined portion and a support portion on the upper end thereof;

said auger shaft having an exteriorly splined portion at the upper end thereof and being positioned in said axial hole with the exteriorly splined portion in splined engagement with the interiorly splined portion of said rotating drive shaft, said auger shaft having supporting screw in the upper end thereof threadedly engaged in said support portion;

an easily assembled and disassembled supporting means on said funnel detachably mounting said funnel around the lower portion of said auger shaft so as to be able to easily disassemble the funnel and auger shaft from the support member of said frame; and a cover for said funnel including a pair of half circular plates mounted on said funnel to cover the upper opening of the funnel and being engaged around said auger shaft; and a charge hopper on said cover for feeding powder into said funnel.

9. An auger feeder as claimed in claim 8 in which said funnel includes an outwardly projecting flange detachably mounted on said support member.

10. An auger feeder as claimed in claim 9 further comprising:

a first conductive member on said frame and electrically connected with said metering cylinder and a second conductive member on said frame and electrically connected with said auger shaft, and an insulating means electrically insulating said conductive members from each other;

a power source for supplying electric power across said first and second conductive members; and a detecting means connected to said conductive members and said power source for detecting a variation of electric power conducted between said conductive members due to an accidental contact between said metering cylinder and said auger screw.

11. An auger feeder comprising:

a frame having a funnel support member thereon;

a funnel supported on said support member for accomodating a powder to be dispensed and having a metering cylinder at the lower end thereof;

drive means on said frame and having a rotational driving shaft;

an auger shaft having an upper end adjacent said drive means and extending through said funnel;

an easily disconnectible connecting means detachably connecting the end of said auger shaft adjacent said driving means with said rotational driving shaft of said driving means for causing said auger shaft and said rotational driving means to rotate together;

an auger screw secured to the lower end of said auger shaft and located within said metering cylinder with a space between the inner surface of said cylinder and said auger screw for causing powder accommodated within said funnel to be metered and dispensed in predetermined amounts in response to the rotation of said auger shaft through predetermined corresponding angles so as to feed powder into containers;

an easily assembled and disassembled supporting means on said funnel detachably mounting said funnel around the lower portion of said auger shaft so as to be able to easily disassemble the funnel and auger shaft from the support member of said frame;

a cover for said funnel including a pair of half circular plates mounted on said funnel to cover the upper opening of the funnel and being engaged around said auger shaft; and a charge hopper on said cover for feeding powder into said funnel; and a resistance member on said metering cylinder and having an outer ring, a plurality of span strips extending radially inwardly from said outer ring and a plurality of curved strips bridging between said span strips for dividing the space within said ring into a plurality of openings defined by said outer ring, said span strips and said curved strips, said resistance member preventing the powder accommodated within said funnel from falling through the metering cylinder due to gravity when said auger screw is not rotating, and permitting powder accommodated with in said funnel to move through said openings when said auger screw is rotated.

12. An auger feeder as claimed in claim 11 in which said metering cylinder has an inner diameter of 2.5–10 mm, said auger screw has a maximum outer diameter of 2.0–9.5 mm, so as to provide space between said auger and said metering cylinder for powder having a size less than 200 m, and said resistance member has a total area of the openings greater than 50% of the area within said outer ring, each of said strips having a width of less than 0.5 mm, said openings having an area of 1–5 mm with the ratio between maximum area and minimum area of said openings being less than 2.0, the shortest diameter and longest diameter passing through the center of gravity of each opening being in a ratio of less than 2.0, and the openings having corner angles of more than substantially 55 degrees.

13. An auger feeder as claimed in claim 11 in which said funnel includes an upper member having the upper opening therein and a lower member having said metering cylinder thereon, said upper member being detachably mounted on said funnel support member and said lower member being detachably mounted on said upper member.

14. An auger feeder as claimed in claim 11 further comprising:

a first conductive member on said frame and electrically connected with said metering cylinder and a second conductive member on said frame and electrically connected with said auger shaft, and an insulating means electrically insulating said conductive members from each other;

a power source for supplying electric power across said first and second conductive members; and a detecting means connected to said conductive members and said power source for detecting a variation of electric power conducted between said conductive members due to an accidental contact between said metering cylinder and said auger screw.

* * * * *